US011128087B2

(12) United States Patent
Zhang

(10) Patent No.: US 11,128,087 B2
(45) Date of Patent: Sep. 21, 2021

(54) FIRST ELECTRICAL CONNECTOR AND ELECTRICAL CONNECTOR ASSEMBLY

(71) Applicant: Molex, LLC, Lisle, IL (US)

(72) Inventor: Teng-Fei Zhang, Shanghai (CN)

(73) Assignee: Molex, LLC, Lisle, IL (US)

( * ) Notice: Subject to any disclaimer, the term of this patent is extended or adjusted under 35 U.S.C. 154(b) by 15 days.

(21) Appl. No.: 16/731,056

(22) Filed: Dec. 31, 2019

(65) Prior Publication Data

US 2020/0220297 A1 Jul. 9, 2020

(30) Foreign Application Priority Data

Jan. 3, 2019 (CN) ..... 20191000379.0

(51) Int. Cl.

| | |
|---|---|
| ***H01R 13/60*** | (2006.01) |
| ***H01R 13/52*** | (2006.01) |
| ***H01R 13/64*** | (2006.01) |
| ***H01R 13/62*** | (2006.01) |
| *H01R 13/24* | (2006.01) |

(52) U.S. Cl.

CPC ..... *H01R 13/521* (2013.01); *H01R 13/6205* (2013.01); *H01R 13/64* (2013.01); *H01R 13/24* (2013.01)

(58) Field of Classification Search

CPC .. H01R 13/521; H01R 13/6205; H01R 13/64; H01R 13/24

USPC ..... 439/38, 39

See application file for complete search history.

(56) References Cited

U.S. PATENT DOCUMENTS

2007/0134947 A1 6/2007 Neidlein

FOREIGN PATENT DOCUMENTS

| | | | |
|---|---|---|---|
| CN | 202633595 | U | 12/2012 |
| CN | 203800286 | U | 8/2014 |
| CN | 203850544 | U | 9/2014 |
| CN | 205141262 | U | 4/2016 |
| CN | 206992406 | U | 2/2018 |
| CN | 207426291 | U | 5/2018 |
| JP | H0421072 | U | 2/1992 |
| JP | H10189168 | A | 7/1998 |
| JP | 2009059586 | A | 3/2009 |

(Continued)

OTHER PUBLICATIONS

Notification of Reasons for Refusal received for JP application No. 2020-000127, dated Dec. 22, 2020, 9 pages. (5 pages of English translation and 4 pages of Official copy).

*Primary Examiner* — Khiem M Nguyen

(57) ABSTRACT

A first electrical connector is provided that comprises a base body, a plurality of first conductive members, two first magnetic attraction members and an elastic waterproof member. The conductive members are fixed to the base body. Each first conductive member has a mating end extending upwardly beyond an upper surface of the base body and a tail end extending out downwardly. The two attraction members are fixed to the base body, and respectively arranged at both sides of the conductive members. The elastic waterproof member is fixed on the upper surface of the base body. The elastic waterproof member is provided with a plurality of through holes, the mating ends of the conductive members correspondingly pass through the plurality of through holes and protrude upwardly. An electrical connector assembly comprises the first electrical connector and a second electrical connector adapted to cooperate therewith.

14 Claims, 10 Drawing Sheets

(56) References Cited

FOREIGN PATENT DOCUMENTS

| | | | |
|---|---|---|---|
| JP | 2014135184 | A | 7/2014 |
| JP | 2016048614 | A | 4/2016 |

FIRST ELECTRICAL CONNECTOR AND ELECTRICAL CONNECTOR ASSEMBLY

RELATED APPLICATIONS

This application claims priority to Chinese Application No. 201910003739.0 filed on Jan. 3, 2019, which is incorporated herein by reference in its entirety.

TECHNICAL FIELD

The present disclosure relates to the field of electrical connectors, especially relates to a first electrical connector having better waterproof performance and an electrical connector assembly.

BACKGROUND ART

The Chinese utility model patent application issuance number CN206992406U discloses a connector for charging and transmitting data in magnetic attraction, the connector comprises a male header and a female header, the male header and the female header are detachably connected, the male header comprises a male header plastic housing, pogo pins and magnetic heads. The pogo pins are perpendicular to a horizontal plane and provided at a central position of the male header plastic housing, the magnetic heads are provided in the male header plastic housing and positioned at both sides of the pogo pins; the female header comprises a female header plastic housing, PIN needles and magnetic heads, the PIN needles are perpendicular to the horizontal plane and provided at a central position of the female header plastic housing, the magnetic heads are provided in the female plastic housing and positioned at both sides of the PIN needles; after the male header and the female header are mounted, the pogo pin contacts the PIN needle; the magnetic head provided in the male header plastic housing corresponds to the magnetic head provided in the female header plastic housing. An outer side of the female header plastic housing is further provided with at least two layers of female header waterproof ring.

In the connector with such a design, the waterproof ring is provided on an outer periphery of a portion of the female header, the portion is used to mate with the male header. For a device employing the female header, a casing of the device needs to open a large opening to allow the female header to extend out outwardly, which destroys the integrity of the casing and affects the overall structure strength and beauty of the casing, and the waterproof performance is not good and needs to be further improved.

SUMMARY

The technical problem to be resolved by the present disclosure is to provide a first electrical connector having better waterproof performance and an electrical connector assembly having the first electrical connector so as to overcome the deficiencies of the prior art described above.

According to an aspect of the present disclosure, the present disclosure provides a first electrical connector comprising a base body, a plurality of first conductive members, two first magnetic attraction members and an elastic waterproof member. The plurality of first conductive members are fixed to the base body, each first conductive member has a mating end extending upwardly beyond an upper surface of the base body and a tail end extending out downwardly. Two first magnetic attraction members are fixed to the base body and respectively arranged at both sides of the plurality of first conductive members. The elastic waterproof member is fixed to the upper surface of the base body, the elastic waterproof member is provided with a plurality of through holes, the mating ends of the plurality of first conductive members correspondingly pass through the plurality of through holes and protrude upwardly.

According to another aspect of the present disclosure, the present disclosure provides an electrical connector assembly comprising a second electrical connector and the first electrical connector as above. The second electrical connector comprises a housing, a plurality of second conductive members fixed to the housing and two second magnetic attraction members respectively arranged on both sides of the plurality of second conductive members. The first magnetic attraction member of the first electrical connector and the second magnetic attraction member of the second electrical connector are magnetically attracted to maintain an electrical connection between the first conductive member and the second conductive member.

Compared with the prior art, the present disclosure has at least following advantages: when the first electrical connector of the present disclosure is applied to an electronic device, only the mating end of each first conductive member extends out from the casing of the electronic device, the casing of the electronic device only needs to open the through holes for the mating ends of the respective first conductive members to be exposed outwardly. Compared with the prior art, when the first electrical connectors of the embodiments are used, the opening on the casing of the electronic device can be set smaller, which is beneficial to enhance the overall structure strength of the casing and maintain the exterior surface to be smooth and beautiful, and reducing ways that external water vapor enters the interior of the electronic device; and at the same time, the elastic waterproof member can abut against the inner surface of the casing of the electronic device to block external water vapor and effectively prevent external water vapor from entering the interior of the electronic device, thereby improving waterproof capability of the electronic device.

DETAILED DESCRIPTION OF THE PREFERRED EMBODIMENTS

Figure 1:
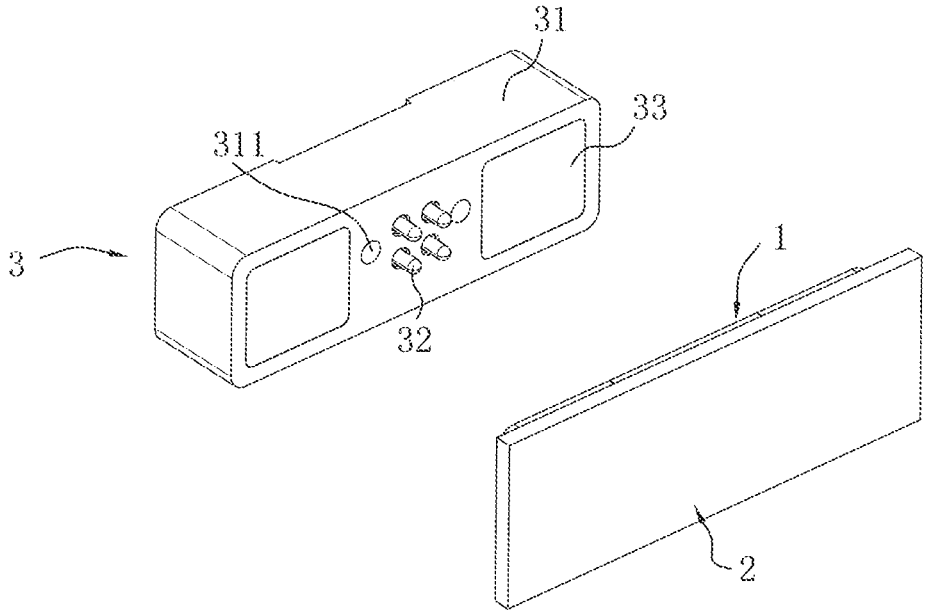
FIG. 1 is a perspective view of a first embodiment of an electrical connector assembly of the present disclosure.

Although the present disclosure may be susceptible to embodiments in different forms, there is shown in the drawings, and herein will be described in detail, specific embodiments, with the understanding that the present disclosure is to be considered an exemplification of the principles of the present disclosure, and is not intended to limit the present disclosure to that as described herein.

Thus, one feature referred in the present disclosure is used to describe one of the features of one embodiment of the present disclosure, and is not intended to imply that each embodiment of the present disclosure must have the described feature. In addition, it should be noted that many features are described in the specification. Although certain features may be combined together to illustrate possible system designs, these features are also applicable to other combinations not explicitly expressed. Accordingly, the described combinations are not intended to limit unless otherwise indicated.

In the embodiments shown in the figures, expressions indicating directions, such as up, down, left, right, front and back, used to describe the structures and movements of each member in the present disclosure are not absolute but rather relative. The descriptions are suitable when these members are in their orientations shown in the figures. In the situation that the orientations of these members change, the indications of these directions also change accordingly.

Hereinafter preferred embodiments of the present disclosure are further described in detail with reference to the drawings of the specification.

Figure 2:
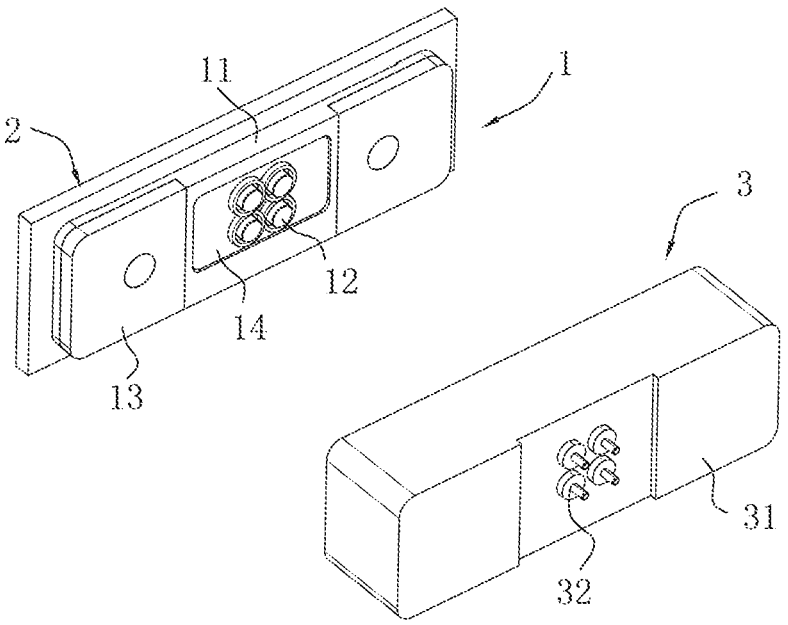
FIG. 2 is a perspective view of FIG. 1 from another angle.
Figure 3:
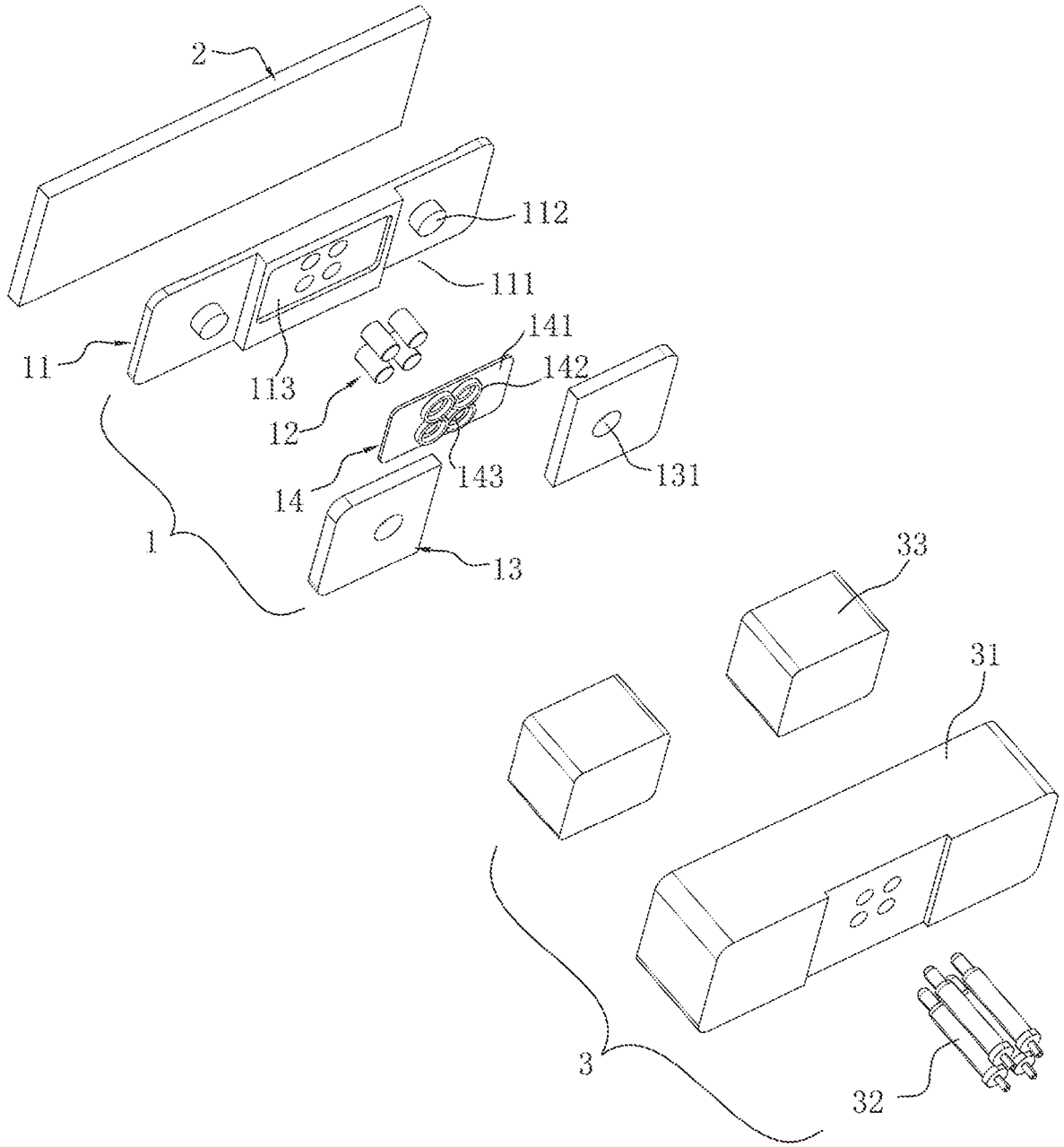
FIG. 3 and FIG. 4 are exploded perspective views of the electrical connector assembly of FIG. 2 from two different angles.
Figure 4:
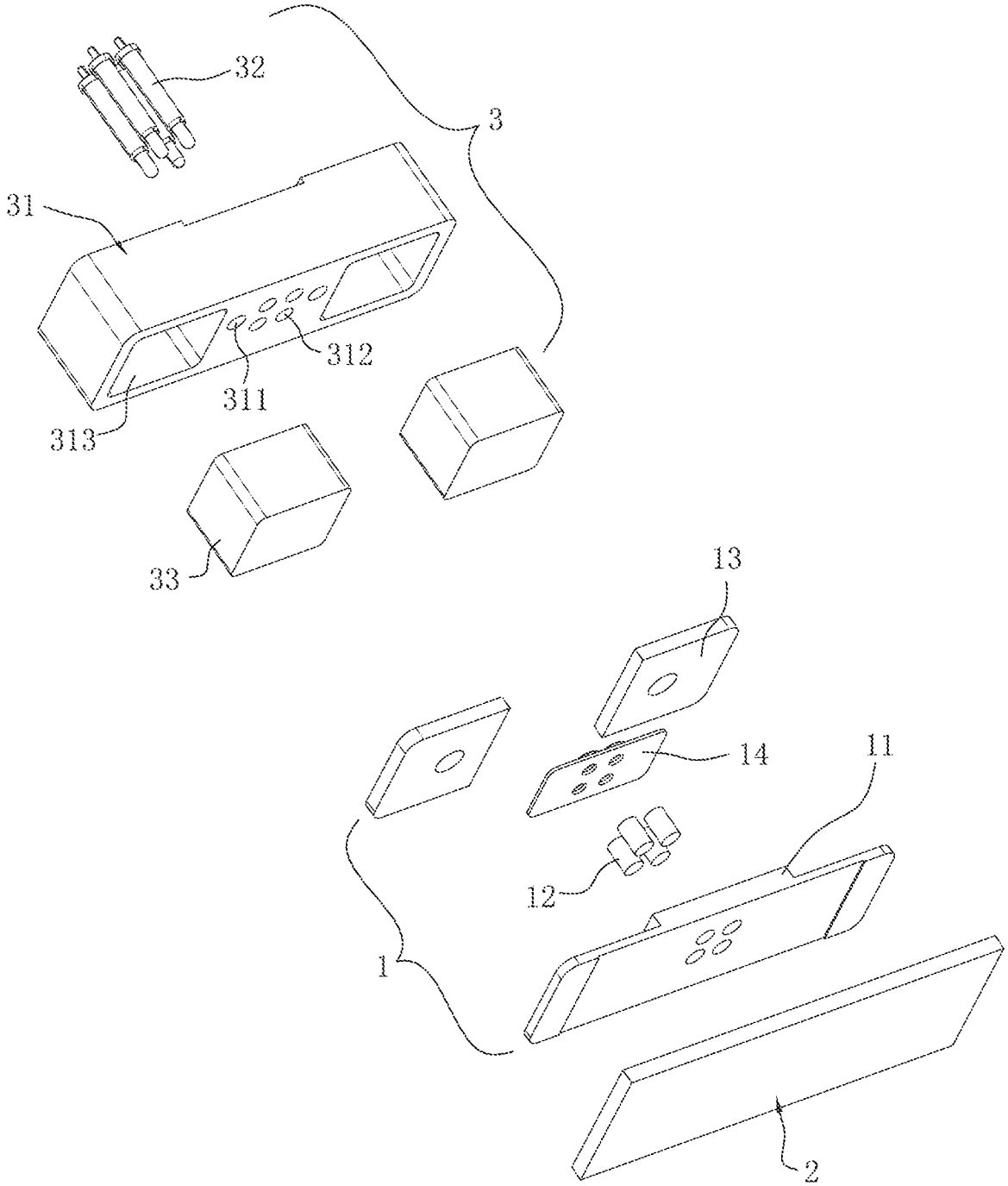

Referring to FIG. 1 and FIG. 2, an electrical connector assembly of the embodiment comprises a first electrical connector 1 and a second electrical connector 3 mated with the first electrical connector 1. The first electrical connector 1 is preferably used to mount on a device end, and is particularly suitable for a receptacle connector in a small electronic device such as a mobile phone or an electronic cigarette lighter. The second electrical connector 3 is preferably used to mount on a cable end, for example used as a plug connector for a charging line or a data transmission line and the like. When in use, the first electrical connector 1 and the second electrical connector 3 are mated with each other to achieve charging or data transmission.

For convenience of description, a direction in which ends of the first electrical connector 1 and the second electrical connector 3 are mated with each other is defined as "up", and a direction away from the end with respect to "up" is "down".

Referring to FIG. 1 to FIG. 4 together, the second electrical connector 3 comprises a housing 31, four second conductive members 32 fixed to the housing 31 and two second magnetic attraction members 33.

The housing 31 can be formed from an insulating material by an injection molding. A middle region of the housing 31 is provided with four terminal holes 312 penetrating along an up-down direction. Two sides of an upper surface of the housing 31 each are provided with a receiving groove 313. In addition, two sides of the four terminal holes 312 each are further provided with a reserved hole 311 which may be used for a reserved terminal hole or a reserved positioning hole.

The four second conductive members 32 may be pogo pins correspondingly inserted into the four terminal holes 312 of the housing 31. The two second magnetic attraction members 33 are fixedly inserted into the receiving groove 313 so as to be respectively positioned at both sides of the four second conductive members 32. The second magnetic attraction member 33 is preferably a magnet such as a ferrite magnet or a neodymium iron boron magnet.

Referring to FIG. 3 to FIG. 7, the first electrical connector 1 comprises a base body 11, four first conductive members 12 respectively fixed to the base body 11, two first magnetic attraction members 13 and an elastic waterproof member 14.

The base body 11 is made of an insulating material. The base body 11 has a substantially rectangular parallelepiped structure. An upper surface of the base body 11 is formed with a receiving groove 111 recessed downwardly at each of two sides in a length direction thereof, the receiving groove 111 transversely penetrates side surfaces of the base body 11 so that the base body 11 forms a stepped structure that a middle portion protrudes upwardly with respect to both sides. The receiving groove 111 is further provided with a fixing protruding post 112 protruding upwardly, the fixing protruding post 112 is substantially positioned at a middle region of the receiving groove 111.

Figure 7:
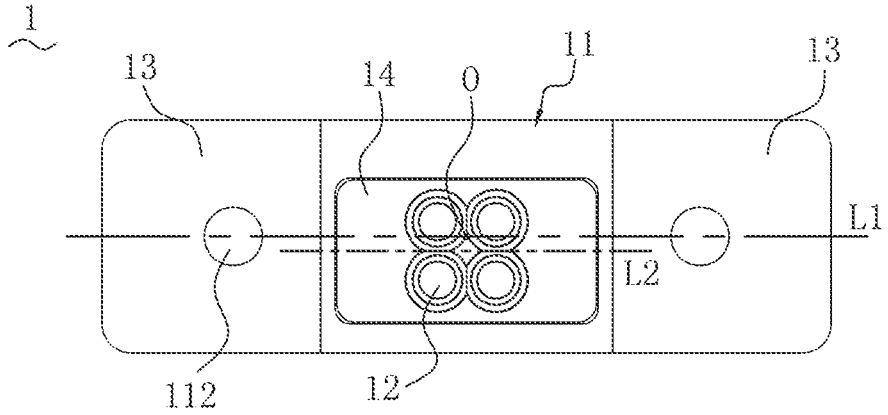
FIG. 7 is a top view of FIG. 5.

A middle portion of the upper surface of the base body 11 is provided with a recessed groove 113 recessed downwardly, a periphery of the recessed groove 113 is closed, a depth of the recessed groove 113 is smaller than a depth of the receiving groove 111. As shown in FIG. 7, the recessed groove 113 has a rectangular shape. The recessed groove 113 biases from a center in a width direction of the base body 11, there is an interval between a center line L2 of the recessed groove 113 and a center line L1 of the base body 11. In other words, the recessed groove 113 is asymmetrically provided in the width direction of the base body 11, that is, the recessed groove 113 is close to one side in the width direction of the base body 11 and relatively farther away from the other side in the width direction of the base body 11.

Figure 5:
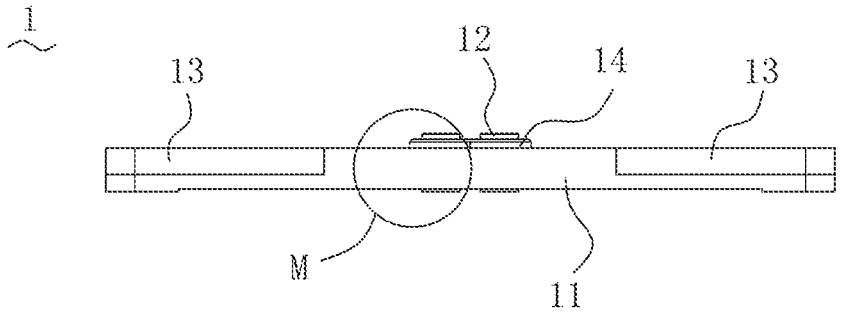
FIG. 5 is a side view of a first electrical connector of FIG. 2.
Figure 6:
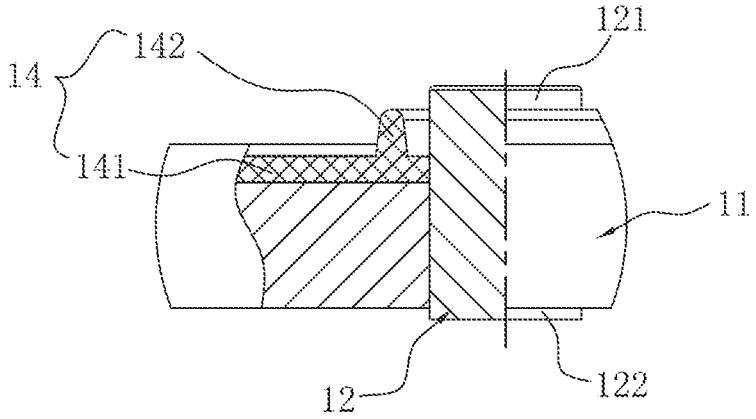
FIG. 6 is a partially enlarged cross-sectional view of FIG. 5 indicated by a circle M.

Referring to FIG. 5 and FIG. 6, the first conductive members 12 are preferably post members of a metal material. Each first conductive member 12 is inserted into the middle portion of the base body 11. A main body portion of the first conductive member 12 is fixed in the base body 11 and has a mating end 121 extending upwardly beyond the upper surface of the base body 11 and a tail end 122 extending out downwardly, the tail end 122 preferably extends beyond a lower surface of the base body 11 or is flush with the lower surface of the base body 11. The first conductive member 12 may be fixed to the base body 11 by an insert molding process. Combining FIG. 1 and FIG. 2, when in use, the tail end 122 of the first conductive member 12 is electrically connected with a circuit board 2 of an electronic device; the mating end 121 of the first conductive member 12 extends outwardly to expose on an outer surface of the electronic device (refer to FIG. 15), and is used to electrically connect with the second conductive member 32 of the second electrical connector 3.

The four first conductive members 12 are arranged as a rectangular shape, the mating end 121 of each first conductive member 12 is positioned in the recessed groove 113. Referring to FIG. 7, the four first conductive members 12 are substantially positioned at a middle portion of the recessed groove 113, and are arranged asymmetrically with respect to a center point O of the base body 11. Specifically, a center line of the rectangular shape as which the four first conductive members 12 arranged coincides with the center line L2 of the recessed groove 113. That is, in the width direction of the base body 11, the four first conductive members 12 also bias from the center line L1, so that the four first conductive members 12 are asymmetrically arranged with respect to the center point O of the base body 11 (that is, the first conductive member 12 in an upper left corner and the first conductive member 12 in a lower right corner are asymmetric with respect to the center point O, the first conductive member 12 in an upper right corner and the first conductive member 12 in a lower left corner are asymmetric with respect to the center point O). The arrangement that the four first conductive members 12 bias to one side makes that the first electrical connector 1 and the second electrical connector 3 can only be properly mated with each other in one direction when the first electrical connector 1 and the second electrical connector 3 are mated with each other, or in other words, all of the first conductive members 12 and the second conductive members 32 can only be correspondingly electrically connected with each other in one direction, such that the first electrical connector 1 and the second electrical connector 3 can be prevented from being improperly mated with each other. Corresponding to the arrangement that the first conductive members 12 bias to one side, the second conductive members 32 of the second electrical connector 3 also bias to one side of the housing 31. It should be noted that, in other embodiments not shown, an arrangement that the first conductive members 12 bias to one side in the length direction of the base body 11 may also achieve an effect that the first electrical connector 1 can only be properly mated in one direction.

Referring to FIG. 2, FIG. 3 to FIG. 7, the first magnetic attraction member 13 has a sheet shape, and the first magnetic attraction member 13 is further provided with a fixing hole 131 penetrating in the up-down direction. The two first magnetic attraction members 13 are respectively fixed in two receiving grooves 111 of the base body 11, the fixing protruding post 112 in the receiving groove 111 extends into the fixing hole 131 and fastens with the first magnetic attraction member 13 together. The two first magnetic attraction members 13 are respectively positioned at both sides of the four first conductive members 12 so as to improve the stability of magnetic attraction when the first electrical connector 1 and the second electrical connector 3 are mated with each other.

The first magnetic attraction member 13 are matched with the receiving groove 111 in shape and size, an upper surface of the first magnetic attraction member 13 is flush with the upper surface of the base body 11, each outer side surface of the first magnetic attraction member 13 is also flush with each outer side surface of the base body 11.

The first magnetic attraction member 13 is preferably fixedly connected with the base body 11 by an insert molding process. At this time, the matching between the fixing hole 131 and the fixing protruding post 112 may facilitate the accurate positioning of the first magnetic attraction member 13, and at the same time further increase a connection area of the first magnetic attraction member 13 and the base body 11, thereby improving the connection strength.

The first magnetic attraction member 13 is preferably made of a ferromagnetic material such as soft iron, silicon steel, nickel iron alloy and the like, for example, the first magnetic attraction member 13 may be an iron piece, which does not have magnetism or only has weak magnetism, such that when the first electrical connector 1 is mounted to an electronic device, the first magnetic attraction member 13 does not interfere with a magnetic member of the electronic device, thereby ensuring the performance of the electronic device.

Referring to FIG. 3 to FIG. 7, the elastic waterproof member 14 comprises a main body 141 and four protrusions 142 integrally formed on the main body 141. A material of the elastic waterproof member 14 can be a silica gel which can have a certain elastic deformation because of its material character.

The main body 141 is a sheet-shape structure which has a substantially rectangular contour and is filled in the recessed groove 113 of the base body 11. A thickness of the main body 141 is slightly smaller than the depth of the recessed groove 113. The main body 141 is provided with four through holes 143, an inner diameter of the through hole 143 is preferably smaller than an outer diameter of the first conductive member 12, the four through holes 143 sheathe outer peripheries of the four first conductive members 12 in watertight manner by one to one correspondence, thereby preventing external water droplets from permeating along a cooperating gap between the through hole 143 and the first conductive member 12.

The protrusion 142 has a substantially ring shape and protrudes upwardly from an upper surface of the main body 141, an upper end of the protrusion 142 extends upwardly beyond the upper surface of the first magnetic attraction member 13. The four protrusions 142 respectively correspond to the four through holes 143, each protrusion 142 encircles a corresponding through hole 143 so as to encircle an outer periphery side of the mating end 121 of each first conductive member 12. The mating end 121 of each first conductive member 12 correspondingly passes through a through hole 143 and protrudes upwardly from the protrusion 142. A diameter of the protrusion 142 is preferably larger than the diameter of the through hole 143, so that there is a certain radial interval between the protrusion 142 and the through hole 143. A thickness of a wall of the protrusion 142 becomes gradually smaller in a direction away from the main body 141, so that an upper end of the protrusion 142 has a minimum thickness, which is more convenient for deformation to occur.

Figure 15:
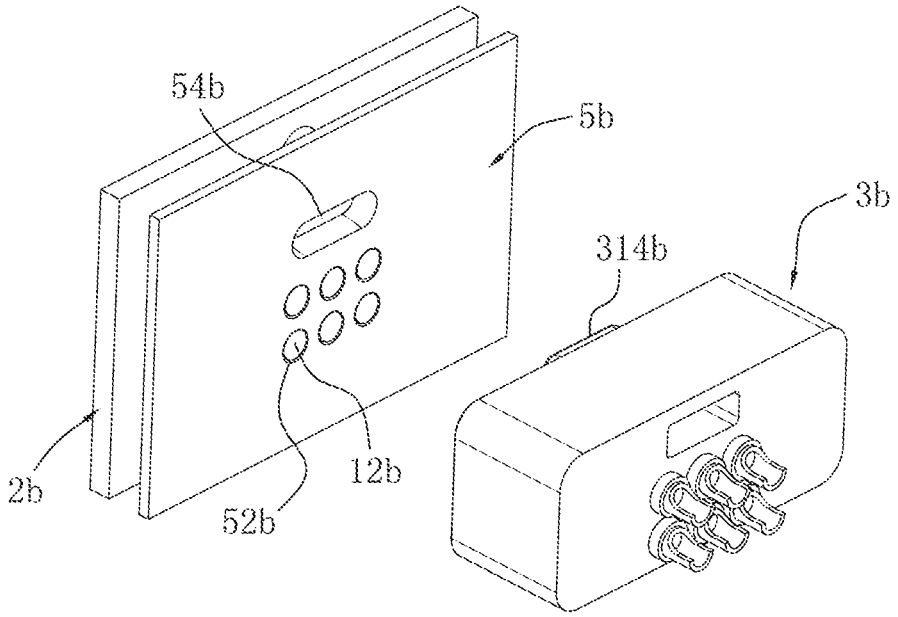
FIG. 15 is a schematic view of the state of using, of the electrical connector assembly of FIG. 11.

When the first electrical connector 1 is applied to an electronic device, the upper end of the protrusion 142 of the elastic waterproof member 14 abuts against an inner surface of the casing of the electronic device, and only the mating end 121 of each first conductive member 12 exposes to the casing of the electronic device, and only a small opening can be opened on the casing of the electronic device, thereby improving the waterproof capability of the electronic device (refer to FIG. 15).

In the embodiment, the elastic waterproof member 14 has the protrusion 142 encircling the outer periphery side of the mating end 121 of each first conductive member 12, which can prevent water droplets from entering the interior of the electronic device along the first conductive member 12 in the radial direction and further improves the waterproof capability.

When an electronic device having the first electrical connector 1 is mated with the second electrical connector 3, the first magnetic attraction member 13 of the first electrical connector 1 and the second magnetic attraction member 33 of the second electrical connector 3 are magnetically attracted together, the first conductive member 12 of the first electrical connector 1 and the second conductive member 32 of the second electrical connector 3 are electrically connected together. The two second magnetic attraction members 33 of the second electrical connector 3 are magnets and are arranged in a same magnetic pole direction (i.e. the two second magnetic attraction members 33 are that both S poles face upwardly or both N poles face upwardly), and when the first magnetic attraction members 13 are iron pieces, when magnetically mated, the magnetic line forms a closed loop only between one of the second magnetic attraction members 33 and the corresponding attracted one of the first magnetic attraction members 13 without going to the other of the second magnetic attraction members 33. In other possible embodiments, the two second magnetic attraction members 33 may also be arranged in opposite magnetic pole directions (i.e. one of the second magnetic attraction members 33 is that the N pole faces upwardly, the other of the second magnetic attraction member 33 is that the S pole faces upwardly).

Figure 8:
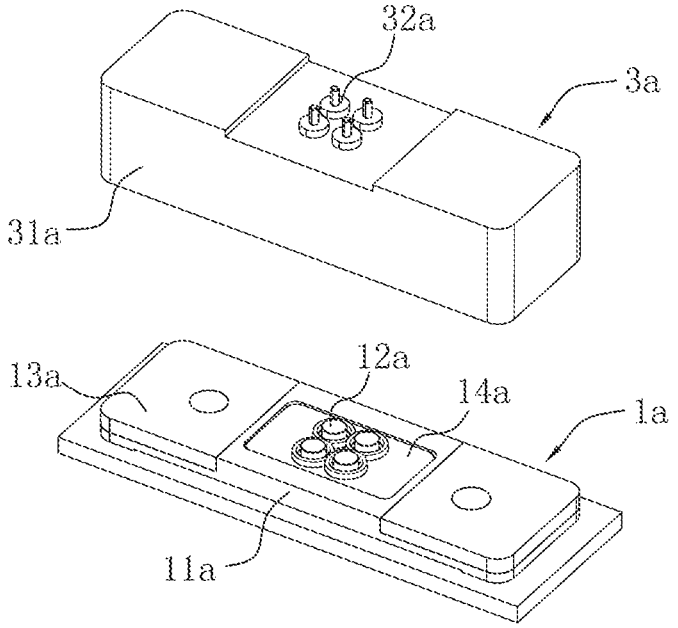
FIG. 8 and FIG. 9 are perspective views of a second embodiment of the electrical connector assembly of the present disclosure.
Figure 9:
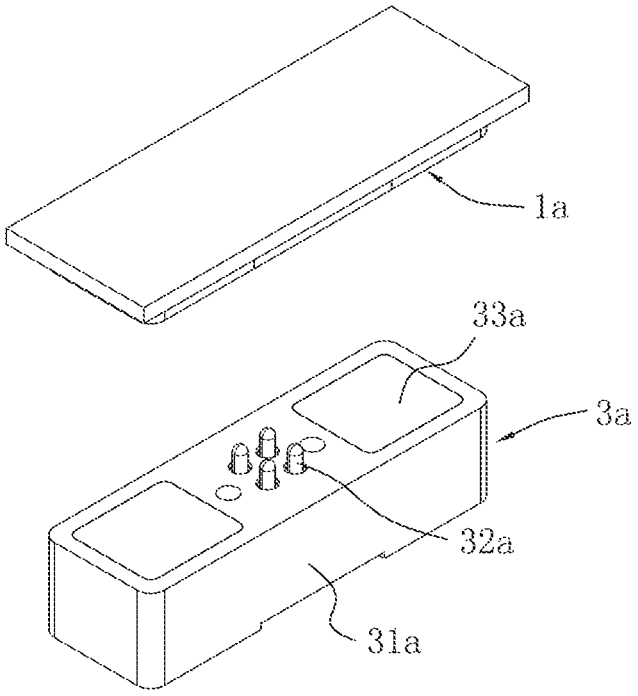
Figure 10:
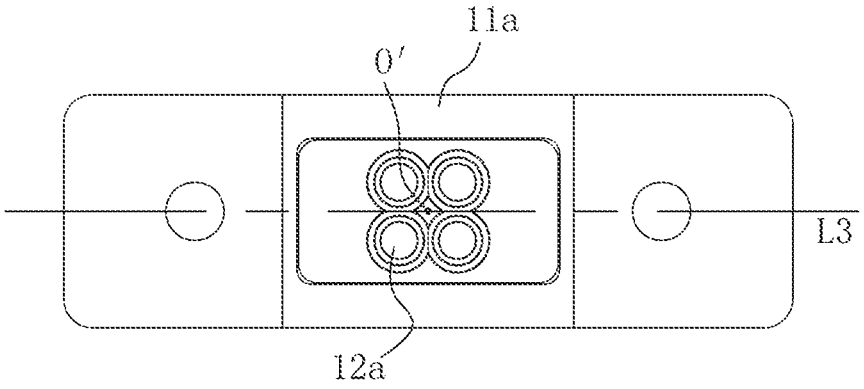
FIG. 10 is a top view of a first electrical connector of FIG. 8.

Referring to FIG. 8 to FIG. 10, the second embodiment of the electrical connector assembly comprises a first electrical connector 1*a* and a second electrical connector 3*a* which are mated with each other.

Similar to the first embodiment, the first electrical connector 1*a* comprises a base body 11*a*, four first conductive members 12*a* respectively fixed to the base body 11*a*, two first magnetic attraction members 13*a* and an elastic waterproof member 14*a*. The second electrical connector 3*a* comprises a housing 31*a*, four second conductive members 32*a* fixed to the housing 31*a* and two second magnetic attraction members 33*a*.

Difference from the first embodiment is: referring to FIG. 10, in the embodiment, the four first conductive members 12*a* are arranged centrally in the width direction of the base body 11*a*, that is, the center line of the rectangular shape as which the four first conductive members 12*a* are arranged coincides with the center line of the base body 11*a*, as shown by the center line L3 of FIG. 10; in addition, the four first conductive members 12*a* are also arranged centrally in the length direction of the base body 11*a*, such that the four first conductive members 12*a* are symmetrically arranged with respect to a center point O' of the base body 11 (i.e. the first conductive member 12*a* in an upper left corner and the first conductive member 12*a* in a lower right corner are symmetric with respect to the center point O', the first conductive member 12*a* in an upper right corner and the first conductive member 12*a* in a lower left corner are symmetric with respect to the center point O').

Corresponding to the first electrical connector 1*a*, in the second electrical connector 3*a*, four second conductive members 32*a* are also symmetrically arranged on the housing 31*a* with respect to a center point of the housing 31*a*. This helps to achieve that the first electrical connector 1*a* and the second electrical connector 3*a* can be mated in two different directions (i.e. a bi-direction insertion of a 180 degrees upside down rotation similar to a USB type-C connector).

Other features of the embodiment can be referred to the first embodiment, and the description thereof will not be repeated here.

In addition, the first electrical connector 1*a* and the second electrical connector 3*a* of the embodiment may also be ensured that they are not improperly mated with each other by other means, for example, some fool-proofing structures (not shown in the figure) may be provided on the casing of the electronic device to realize that the two first electrical connector 1*a* and the second electrical connector 3*a* can only be properly mated with each other in one direction.

Referring to FIG. 11 to FIG. 17, the third embodiment of the electrical connector assembly comprises a first electrical connector 1*b* and a second electrical connector 3*b* which are mated with each other.

Figure 11:
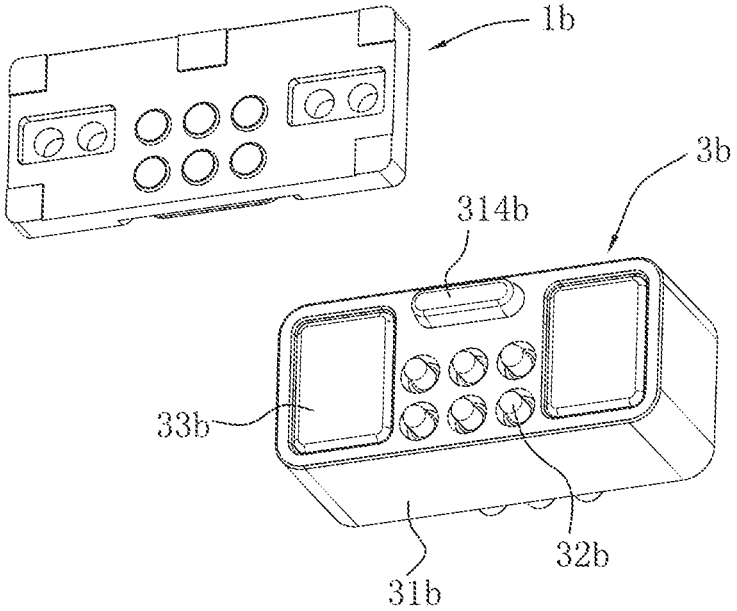
FIG. 11 is a perspective view of a third embodiment of the electrical connector assembly of the present disclosure.
Figure 12:
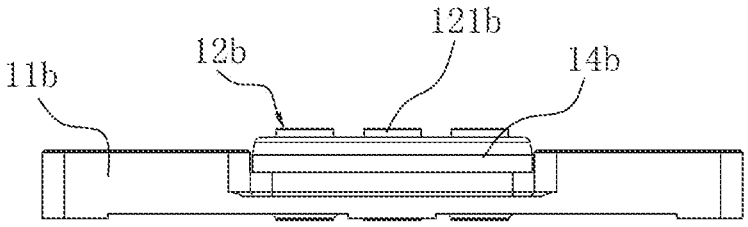
FIG. 12 is a side view of a first electrical connector of FIG. 11.
Figure 14:
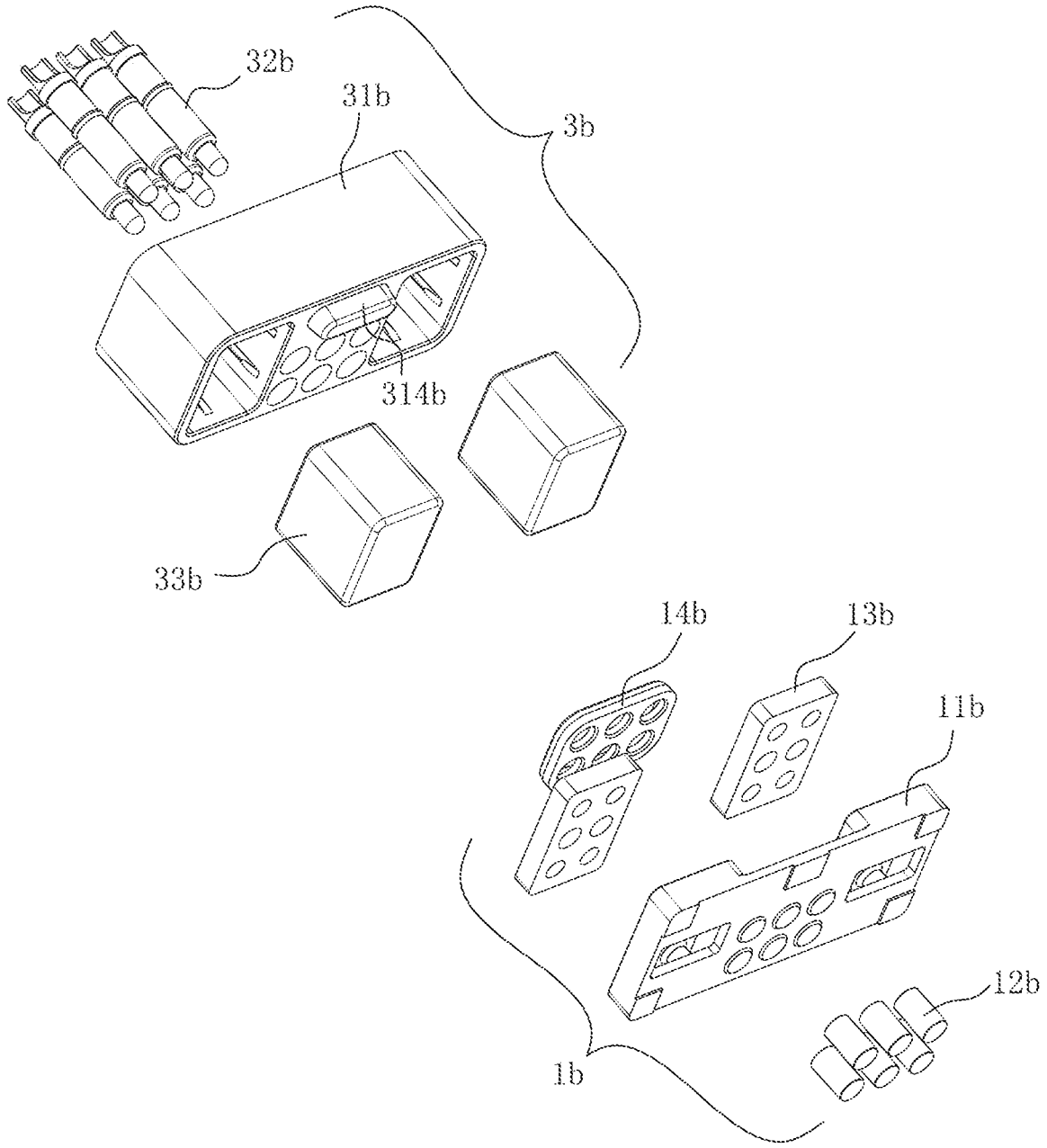

Referring to FIG. 11 and FIG. 14, the second electrical connector 3*b* comprises a housing 31*b*, six second conductive members 32*b* fixed to the housing 31*b* and two second magnetic attraction members 33*b*. The six second conductive members 32*b* are arranged asymmetrically with respect to a center point of the base body 31*b*. Specifically, the six second conductive members 32*b* are divided into two rows, fixed at a middle portion in the length direction of the housing 31*b*, and bias to one side in the width direction of the housing 31*b* (i.e. are arranged that the six second conductive members 32*b* bias from the center line in the width direction). The two second magnetic attraction members 33*b* are arranged respectively at both sides of the six second conductive members 32*b* in the length direction of the housing 31*b*. The maximum difference from the first embodiment is that: in the embodiment, the upper surface of the housing 31*b* is provided with a positioning protrusion 314*b* protruding upwardly at the other side of the second conductive members 32*b* in the width direction of the housing 31*b*. The second conductive members 32*b* are preferably Pogo Pins.

As shown in FIG. 12 to FIG. 14 and FIG. 16, the first electrical connector 1*b* comprises a base body 11*b*, six first conductive members 12*b* respectively fixed to the base body 11*b*, two first magnetic attraction members 13*b* and an elastic waterproof member 14*b*. The first conductive members 12*b* are preferably conductive metal posts formed by line cutting.

Figure 13:
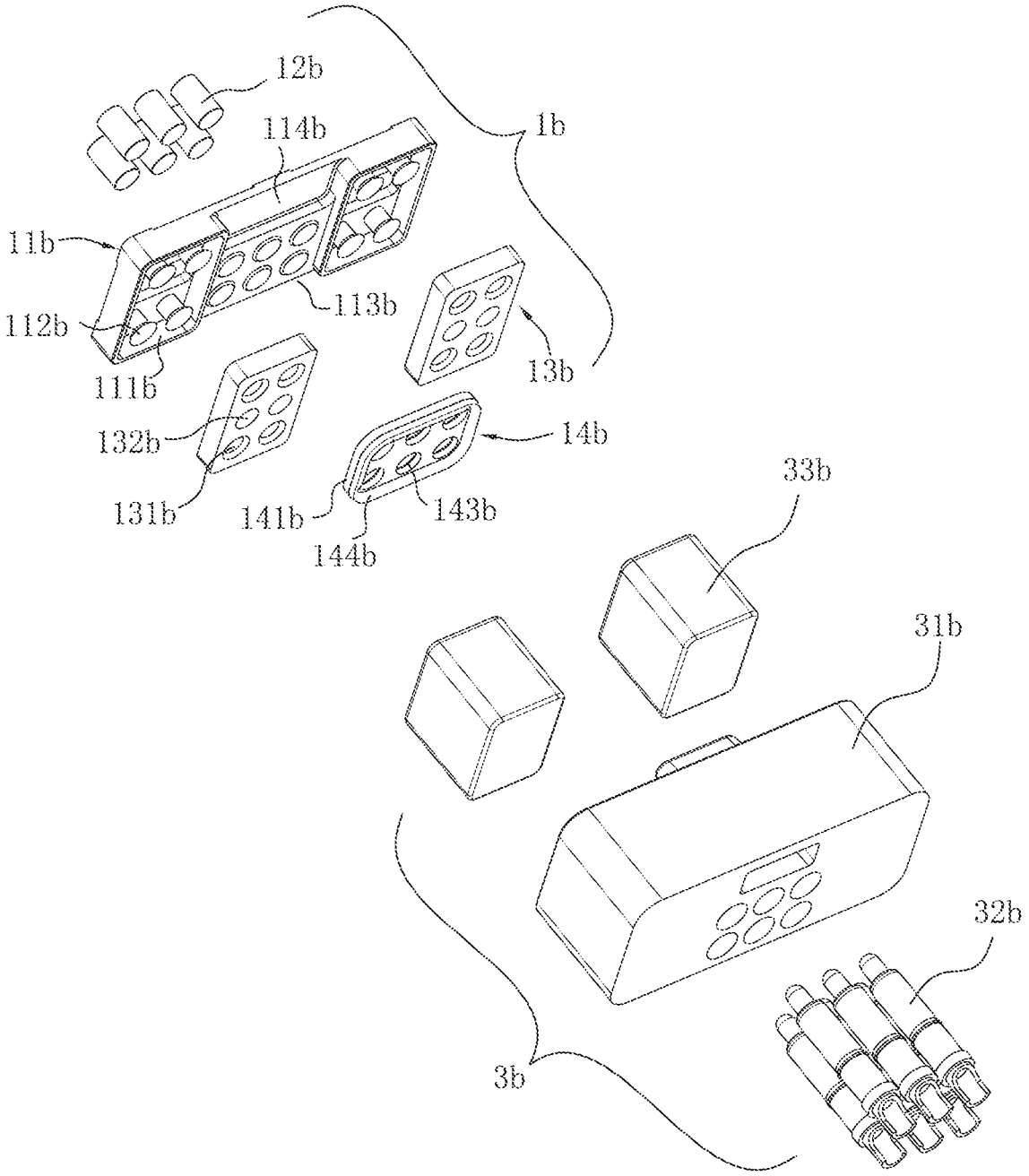
FIG. 13 and FIG. 14 are exploded perspective views of the electrical connector assembly of FIG. 11 from two different angles.

Referring to FIG. 13, similar to the first embodiment, the upper surface of the base body 11*b* is provided with a receiving groove 11*b* at each of both sides in the length direction and a recessed groove 113*b* at a middle portion in the length direction.

The difference from the first embodiment is that: in the embodiment, the periphery of the receiving groove 11*b* is closed, but the recessed groove 113*b* penetrates both sides in the width direction of the base body 11*b* such that the middle portion of the base body 11*b* is lower than the both sides of the base body 11*b*. In addition, the recessed groove 113*b* bias to one side in the width direction of the base body 11*b*, the upper surface of the base body 11*b* is recessed with a positioning recessed groove 114*b* recessed downwardly at the other side in the width direction of the recessed groove 113*b*, and a bottom surface of the positioning recessed groove 114*b* is lower than a bottom surface of the recessed groove 113*b*. The positioning recessed groove 114*b* can offer a space to the positioning protrusion 314*b* of the second electrical connector 3*b* to facilitate the accurate positioning of the first electrical connector 1*b* and the second electrical connector 3*b*.

Combining FIG. 12 to FIG. 14 and FIG. 16, the first magnetic attraction member 13*b* is mounted in the receiving groove 111*b*, and an upper surface of each first magnetic attraction member 13*b* is flush with the upper surface of the base body 11*b*. In the embodiment, each receiving groove 111*b* is provided with four fixing protruding posts 112*b*. Four corners of the first magnetic attraction member 13*b* are correspondingly provided with four fixing holes 131*b*. Preferably, in the embodiment, each fixing protruding post 112*b* extends into the corresponding fixing hole 131*b*, and then an end portion of each fixing protruding posts 112*b* is hot melted such that the first magnetic attraction member 13*b* is fixed to the base body 11*b*. In the embodiment, the first magnetic attraction member 13*b* may also be fixed to the base body 11*b* by an insert molding process, each first magnetic attraction member 13*b* is further provided with two positioning holes 132*b* for inserting and positioning mold pins (not shown in the figure), so as to facilitate fixing of the first magnetic attraction member 13*b* to the base body 11*b* by an insert molding process.

The six first conductive members 12*b* are divided into two rows, and are arranged as a rectangular shape in the middle portion of length direction of the base body 11*b*, the mating end 121*b* of each first conductive member 12*b* is positioned in the recessed groove 113*b*, and extends upwardly beyond the upper surface of the base body 11*b*. The six first conductive members 12*b* are arranged to bias from the center line of the base body 11*b*, such that the first conductive members 12*b* of the first electrical connector 1*b* and the second conductive members 32*b* of the second electrical connector 3*b* can only be mated with each other in unique one direction.

The elastic waterproof member 14*b* comprises a main body 141*b* and a protrusion 144*b* integrally formed on the main body 141*b* and protruding upwardly from the main body 141*b*. In the embodiment, the protrusion 144*b* is provided along a periphery of the main body 141*b*, and the protrusion 142 is not separately provided corresponding to each through hole 143*b*. The protrusion 144*b* encircles the six first conductive members 12*b* as a whole and also functions to block water vapor conduction path between inside and outside of the region where the first conductive members 12*b* are positioned. A lower surface of the main body 141*b* may be fixed to the base body 11*b* by bonding or other feasible means. An upper end of the protrusion 144*b* extends beyond the upper surface of the first magnetic attraction member 13*b*.

Other technical features not described in the embodiment can be referred to the first embodiment, and the description will not be repeated.

Figure 16:
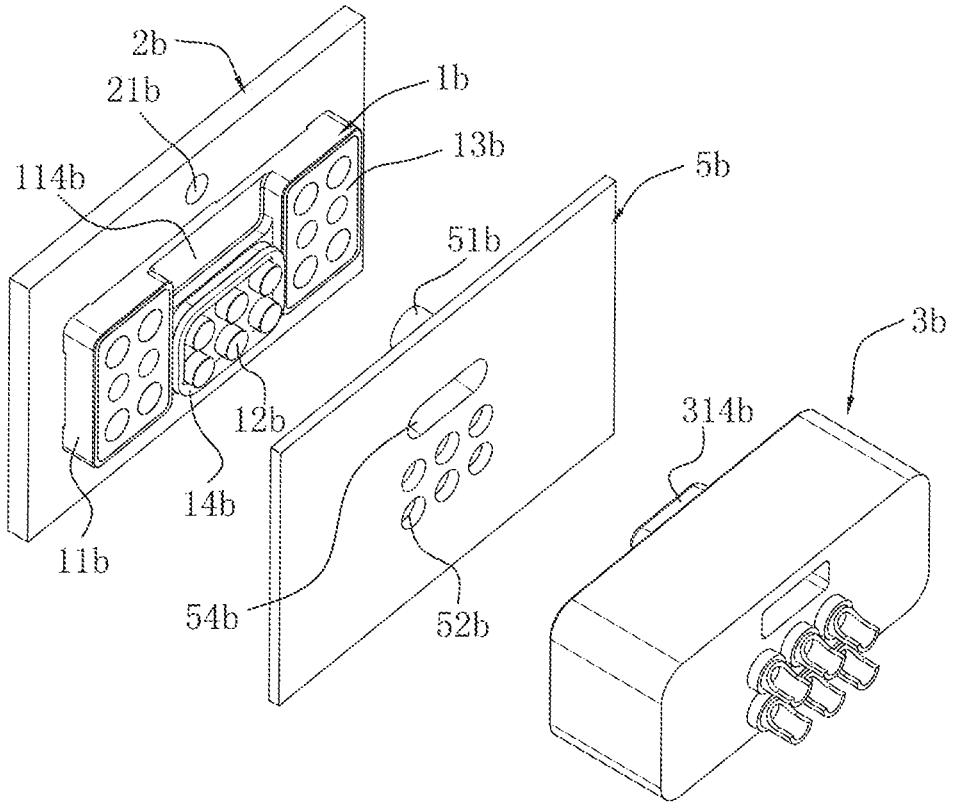
FIG. 16 and FIG. 17 are exploded perspective views of FIG. 15 from two different angles.
Figure 17:
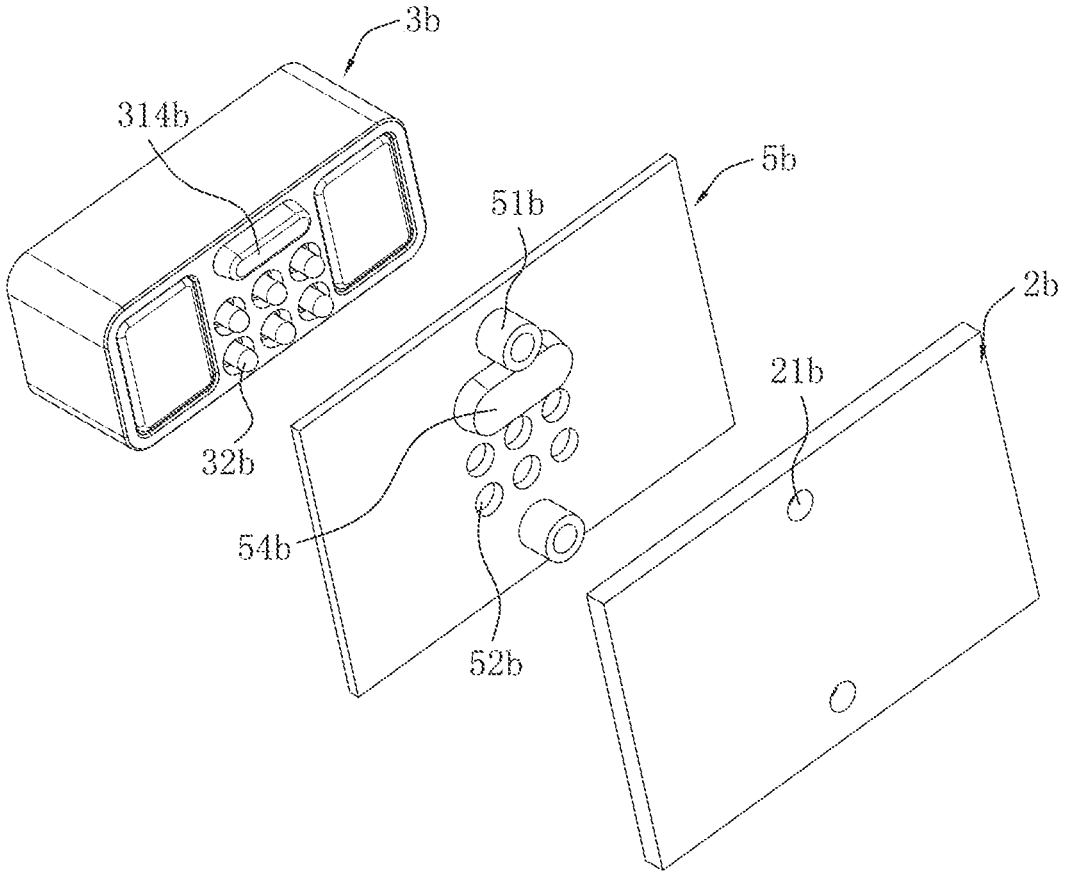

Referring to FIG. 15 to FIG. 17, when the first electrical connector 1*b* of the embodiment is applied to an electronic device, the first electrical connector 1*b* is mounted on a circuit board 2*b* and positioned inside a casing 5*b* (the casing 5*b* as shown is only a simplified example) of the electronic device. The circuit board 2*b* is provided with a positioning through hole 21*b* at each side of the first electrical connector 1*b*; two positioning protruding posts 51*b* correspondingly protrude from an inner surface of the casing 5*b*, the positioning protruding posts 51*b* and the positioning through holes 21*b* are cooperated with each other and may be locked together by screws to facilitate the accurate positioning of assembling of the circuit board 2*b* and the casing 5*b*.

The casing 5*b* is provided with six through holes 52*b*. The mating ends of the six first conductive members 12*b* of the first electrical connector 1*b* correspondingly extend into the six through holes 52*b*, and end faces of the mating ends of the first conductive members 12*b* are exposed on an surface of the electronic device, and thus can be electrically connected with the second conductive members 32*b* of the second electrical connector 3*b*.

The casing 5*b* is further provided with a sunk groove 54*b* recessed toward an inner side of the electronic device at one side of the six through holes 52*b*, a bottom surface of the sunk groove 54*b* is closed. The sunk groove 54*b* extends into the positioning recessed groove 114*b* of the first electrical connector 1*b*. The sunk groove 54*b* may correspondingly receive the positioning protrusion 314*b* of the second electrical connector 3*b* to facilitate the accurate mating of the electronic device and the second electrical connector 3*b*.

In the electronic device, the casing 5*b* only needs to open the through holes 52*b* thereon to allow the first electrical connector 1*b* to mate with the second electrical connector 3*b*, and the elastic waterproof member 14*b* of the first connector 1*b* elastically abuts against the inner surface of the casing 5*b*, the through hole 143*b* of the elastic waterproof member 14*b* is cooperated with the first conductive member 12*b* in watertight manner to prevent water vapor from permeating along a cooperating gap between the through hole 143*b* and the first conductive member 12*b*, and at the same time, the protrusion 144*b* of the elastic waterproof member 14*b* encircles the through holes 52*b* and the first conductive member 12*b*, and blocks water vapor entering through the through holes 52*b* from further entering the interior of the electronic device, thereby improving the waterproof capability of the electronic device.

According to embodiments described above, when the first electrical connector 1/1*a*/1*b* of the present disclosure is applied to an electronic device, only the mating end 121/121*a*/121*b* of each first conductive member 12/12*a*/12*b* extends out from the casing of the electronic device, the casing of the electronic device only needs to open through holes for the mating ends 121/121*a*/121*b* of the respective first conductive members 12/12*a*/12*b* to be exposed outwardly. Compared with the prior art, when the first electrical connectors 1/1*a*/1*b* of the embodiments are used, the opening on the casing of the electronic device can be set smaller, which is beneficial to enhance the overall structure strength of the casing and maintain the exterior surface to be smooth and beautiful, and reducing ways that external water vapor enters the interior of the electronic device; and at the same time, the elastic waterproof member 14/14*a*/14*b* can abut against the inner surface of the casing of the electronic device to block external water vapor and effectively prevent external water vapor from entering the interior of the electronic device, thereby improving waterproof capability of the electronic device.

The contents described above are only preferred embodiments of the present disclosure and is not intended to limit implementation solutions of the present disclosure, persons skilled in the art can conveniently make various modifications and changes according to the main concept and spirit of the present disclosure, therefore the scope of the present disclosure should be determined by the scope of the claims.

The invention claimed is:

1. A first electrical connector, comprising:

a base body;

a plurality of first conductive members fixed to the base body, each first conductive member having a first end extending upwardly beyond an upper surface of the base body and a second end extending downwardly beyond a lower surface of the base body, the plurality of first conductive members being fixed to the base body between the first and second ends;

two first magnetic attraction members fixed to the base body and respectively arranged at both sides of the plurality of first conductive members;

the first electrical connector further comprising:

an elastic waterproof member fixed to the upper surface of the base body, the elastic waterproof member being provided with a plurality of through holes, the first ends of the plurality of first conductive members correspondingly passing through the plurality of through holes and protruding upwardly.

2. The first electrical connector according to claim 1, wherein the elastic waterproof member comprises a main body and a plurality of protrusions integrally formed on the main body, each protrusion correspondingly encircles one through hole and protrudes upwardly from the main body.

3. The first electrical connector according to claim 1, wherein the elastic waterproof member comprises a main body and a protrusion integrally formed on the main body, the protrusion is provided along a periphery of the main body and protrudes upwardly from the main body such that the protrusion encircles the plurality of through holes therein.

4. The first electrical connector according to claim 2, wherein an upper end of the protrusion extends upwardly beyond an upper surface of the first magnetic attraction member.

5. The first electrical connector according to claim 1, wherein a middle portion of the upper surface of the base body is provided with a recessed groove, the first ends of the plurality of first conductive members are positioned in the recessed groove, the elastic waterproof member is filled in the recessed groove.

6. The first electrical connector according to claim 1, wherein a receiving groove is provided at each of two sides of the upper surface, at least one fixing protruding post is provided in the receiving groove;

the first magnetic attraction member is an iron piece, and is provided with at least one fixing hole penetrating along an up-down direction; the first magnetic attraction member is fixed in the receiving groove, the fixing protruding post correspondingly extends into the fixing hole and fastens with the first magnetic attraction member together.

7. The first electrical connector according to claim 1, wherein the through hole of the elastic waterproof member and the first conductive member are cooperated with each other in watertight manner.

8. The first electrical connector according to claim 1, wherein the plurality of first conductive members are symmetrically arranged with respect to a center point of the base body.

9. The first electrical connector according to claim 8, wherein the plurality of first conductive members are a plurality of post members arranged as a rectangular shape, and there is an interval between a center line of the rectangular shape and a center line of the base body.

10. The first electrical connector according to claim 1, wherein the upper surface of the base body is provided with a positioning recessed groove recessed downwardly at a side of the plurality of first conductive member, a bottom surface of the positioning recessed groove is lower than an upper surface of the first magnetic attraction member.

11. An electrical connector assembly, comprising a first electrical connector and a second electrical connector, the second electrical connector comprising a housing, a plurality of second conductive members fixed to the housing and two second magnetic attraction members respectively arranged on both sides of the plurality of second conductive members;

the first electrical connector being the first electrical connector according to any one of claims 1 to 10;

the first magnetic attraction member of the first electrical connector and the second magnetic attraction member of the second electrical connector being magnetically attracted to maintain an electrical connection between the first conductive member and the second conductive member.

12. The electrical connector assembly according to claim 11, wherein the two second magnetic attraction members are two magnets which are arranged in a same magnetic pole direction, and the plurality of second conductive members are pogo pins.

13. The electrical connector assembly according to claim 11, wherein the plurality of second conductive members are arranged to bias to one side of the housing.

14. The electrical connector assembly according to claim 13, wherein the housing is provided with a positioning protrusion protruding upwardly at the other side of the housing with respect to the one side to which the plurality of second conductive members bias.

* * * * *